US009109599B2

(12) United States Patent
Lee et al.

(10) Patent No.: US 9,109,599 B2
(45) Date of Patent: Aug. 18, 2015

(54) SCROLL COMPRESSOR HAVING OIL HOLE

(71) Applicants: Jaesang Lee, Seoul (KR); Byeongchul Lee, Seoul (KR); Taemin Earmme, Seoul (KR); Namkyu Cho, Seoul (KR)

(72) Inventors: Jaesang Lee, Seoul (KR); Byeongchul Lee, Seoul (KR); Taemin Earmme, Seoul (KR); Namkyu Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 145 days.

(21) Appl. No.: 13/624,044

(22) Filed: Sep. 21, 2012

(65) Prior Publication Data

US 2013/0071278 A1 Mar. 21, 2013

(30) Foreign Application Priority Data

Sep. 21, 2011 (KR) ..... 10-2011-0095472

(51) Int. Cl.

| | |
|---|---|
| ***F03C 2/00*** | (2006.01) |
| ***F04C 2/00*** | (2006.01) |
| ***F04C 18/00*** | (2006.01) |
| ***F04C 18/02*** | (2006.01) |
| ***F04C 29/02*** | (2006.01) |
| *F04C 23/00* | (2006.01) |
| *F04C 29/00* | (2006.01) |

(52) U.S. Cl.

CPC ..... *F04C 18/0269* (2013.01); *F04C 18/0215* (2013.01); *F04C 18/0253* (2013.01); *F04C 18/0292* (2013.01); *F04C 29/023* (2013.01); *F04C 23/008* (2013.01); *F04C 29/0057* (2013.01); *F04C 2240/56* (2013.01); *F04C 2240/603* (2013.01); *F04C 2240/809* (2013.01)

(58) Field of Classification Search

CPC ..... F04C 18/0215; F04C 18/0253; F04C 18/0269; F04C 18/0292; F04C 23/008; F04C 29/023; F04C 29/026; F04C 2240/56; F04C 2240/603; F04C 2240/809; F01C 1/0215; F01C 1/0246; F01C 1/0253; F01C 1/0269; F01C 1/0292

USPC ..... 418/88, 94, 55.1–55.6, 57, 102

See application file for complete search history.

(56) References Cited

U.S. PATENT DOCUMENTS 4,487,560 A * 12/1984 Uchikawa et al. ..... 418/55.2
4,552,518 A * 11/1985 Utter ..... 418/55.6

(Continued)

FOREIGN PATENT DOCUMENTS

CN 102032177 A 4/2011
JP 62291401 A * 12/1987 ..... F01C 1/02

(Continued)

OTHER PUBLICATIONS

Korean Office Action dated Jun. 13, 2013.

(Continued)

*Primary Examiner* — Theresa Trieu
(74) *Attorney, Agent, or Firm* — Ked & Associates, LLP

(57) ABSTRACT

A scroll compressor is provided. That is, in a shaft penetration scroll compressor in which an eccentric portion of the rotational shaft is overlapped with an orbiting wrap of the orbiting scroll in a radial direction, an oil hole that supplies oil inhaled through an oil passage of the rotational shaft to a thrust bearing surface of the orbiting scroll may be formed at the fixed scroll, and thus, the orbiting scroll may be supported by pressure of oil supplied to the thrust bearing surface through the oil hole to prevent tilting of the orbiting scroll due to eccentricity of a gas force, thereby enhancing reliability and performance of the compressor.

15 Claims, 8 Drawing Sheets

(56) References Cited

U.S. PATENT DOCUMENTS

| | | | | |
|---|---|---|---|---|
| 5,304,047 | A * | 4/1994 | Shibamoto | 418/60 |
| 6,030,192 | A * | 2/2000 | Hill et al. | 418/55.2 |
| 8,308,460 | B2 * | 11/2012 | Seong et al. | 418/55.2 |

FOREIGN PATENT DOCUMENTS

| | | | | |
|---|---|---|---|---|
| JP | 03105091 | A * | 5/1991 | F04C 18/02 |
| JP | 08-200250 | | 8/1999 | |
| JP | H11-247779 | A | 9/1999 | |
| JP | 2011-017304 | | 1/2011 | |
| KR | 10-1059880 | | 8/2011 | |

OTHER PUBLICATIONS

Korean Office Action dated Dec. 18, 2012.

Chinese Office Action dated Sep. 30, 2014, issued in Application No. 201210355703.7 (with English translation).

* cited by examiner (a) (b)

(a) (b)

SCROLL COMPRESSOR HAVING OIL HOLE

CROSS-REFERENCE TO RELATED APPLICATIONS

The present disclosure relates to subject matter contained in priority Korean Application No. 10-2011-0095472, filed on Sep. 21, 2011, which is herein expressly incorporated by reference in its entirety.

BACKGROUND OF THE INVENTION

1. Field of the Invention

The present disclosure relates to a scroll compressor.

2. Description of the Related Art

Scroll compressor may include a fixed scroll having a fixed wrap and a orbiting scroll having a orbiting wrap. The scroll compressor provides a method of inhaling and compressing refrigerant through a continuous volume change of the compression chamber formed between the fixed wrap and the orbiting wrap while the orbiting scroll performs a orbiting movement on the fixed scroll.

Furthermore, the scroll compressor continuously performs inhalation, compression and discharge, and thus has excellent characteristics in the aspect of vibration and noise generated during its operational process compared to other types of compressors.

In a scroll compressor, the behavior characteristic is determined by its type of the fixed wrap and orbiting wrap. The fixed wrap and orbiting wrap may have an arbitrary shape, but typically have an involute curved shape that can be easily processed. The involute curve denotes a curve corresponding to a trajectory drawn by a cross section of thread when unloosing thread wound around a base circle having an arbitrary radius. When using such an involute curve, the capacity change rate is constant because a thickness of the wrap is constant and thus the number of turns should be increased to obtain a sufficient level of compression ratio, but it may also increase the size of the compressor.

On the other hand, the orbiting scroll is typically formed with a disk shaped end plate and the orbiting wrap at the side of the end plate. Furthermore, a boss portion is formed at a rear surface on which the orbiting wrap is not formed and connected to a rotation shaft for orbiting the orbiting scroll. Such a shape may form a orbiting wrap over a substantially overall area of the end plate, thereby decreasing a diameter of the end plate portion for obtaining the same compression ratio. However, on the contrary, the operating point to which a repulsive force of refrigerant is applied and the operating point to which a reaction force for cancelling out the repulsive force is applied are separated from each other in an axial direction, thereby causing a problem of increasing vibration or noise while the orbiting scroll is tilted during the operational process.

As a method for solving such problems, there has been disclosed a so-called shaft penetration scroll compressor which is a type that a position at which the rotation shaft and the orbiting scroll are combined with each other is formed on the same surface as the orbiting wrap. In such a type of compressor, the operating point of a repulsive force and the operating point of the reaction force are applied at the same position, thereby solving a problem that the orbiting scroll is inclined. However, when the rotation shaft is extended to a orbiting wrap portion in such a manner, an end portion of the rotation shaft is located at a central portion of the orbiting wrap, and accordingly, an intentional compression ratio can be obtained only when increasing the diameter of the end plate. As a result, it may increase the size of the compressor.

However, in case of a shaft penetration scroll compressor as described above, a suction port is eccentrically formed with respect to the center of the rotation shaft as illustrated in the drawing, and thus a gas force is eccentrically exerted and due to this there has been a problem of causing tilting due to the eccentricity of the gas force.

SUMMARY OF THE INVENTION

An object of the present disclosure is to provide a scroll compressor including a fixed scroll having a fixed wrap; a orbiting scroll configured to have a orbiting wrap engaged with the fixed wrap to form a first and a second compression chamber at an inner surface and an outer surface thereof, and perform a orbiting movement against the fixed scroll; a rotation shaft configured to have an eccentric portion at an end portion thereof, and formed with an oil passage in an axial direction, and combined with the orbiting scroll such that the eccentric portion is overlapped with the orbiting wrap in a radial direction; and a driving unit configured to drive the rotation shaft, wherein an oil hole is formed at the fixed scroll to supply oil inhaled through the oil passage of the rotation shaft to a thrust bearing surface with the orbiting scroll, and an outlet end of the oil hole is formed to pass through the thrust bearing surface of the orbiting scroll.

Furthermore, there is provided a scroll compressor including a fixed scroll having a fixed wrap; a orbiting scroll configured to have a orbiting wrap engaged with the fixed wrap to form compression chambers at an inner surface and an outer surface thereof, respectively, and perform a orbiting movement against the fixed scroll; a rotation shaft configured to have an eccentric portion at an end portion thereof, and combined with the orbiting scroll such that the eccentric portion is overlapped with the orbiting wrap in a radial direction; and a driving unit configured to drive the rotation shaft, wherein, a boss portion is formed at the fixed scroll into which the rotation shaft is inserted and rotatably supported, and an inlet end of the oil hole is formed to pass through an inner circumferential surface of the boss portion, and an outlet end of the oil hole is formed to pass through a thrust bearing surface corresponding to the orbiting scroll.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, a scroll compressor according to the present disclosure will be described in detail based on an embodiment illustrated in the accompanying drawings.

Figure 1:
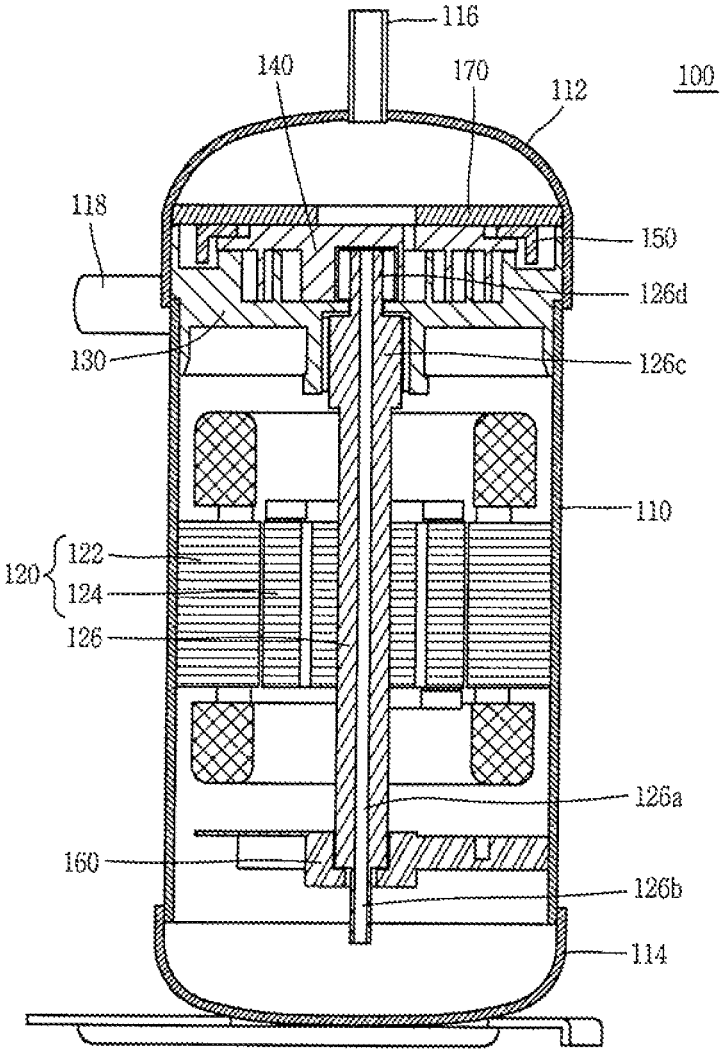
FIG. 1 is a cross-sectional view schematically illustrating the internal structure of a scroll compressor according to an embodiment of the present disclosure.
Figure 2:
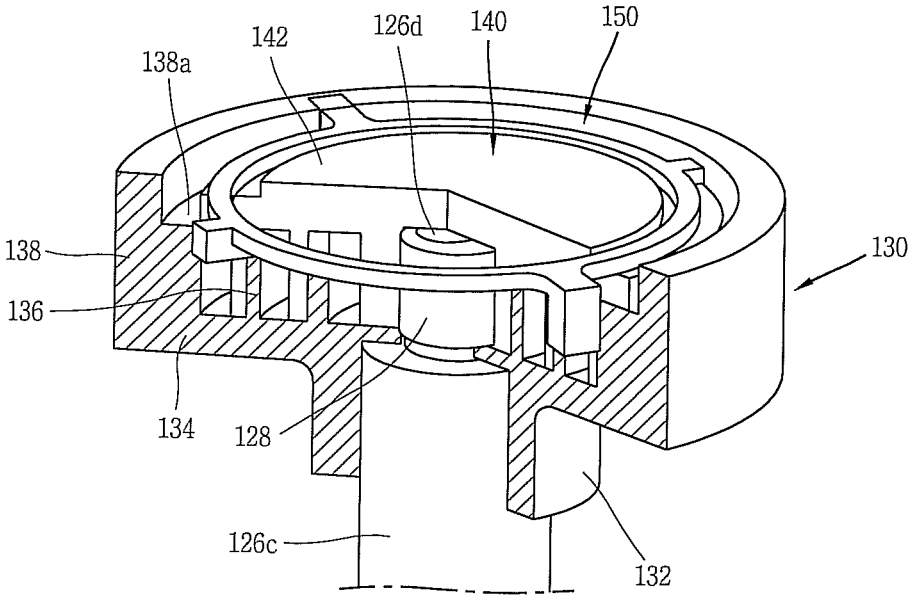
FIG. 2 is a partial cross-sectional view illustrating a compression unit in the embodiment illustrated in FIG. 1.

Referring to FIG. 1, a scroll compressor according to the present embodiment has a cylindrically shaped casing 110, and an upper shell 112 and a lower shell 114 for covering an upper portion and a lower portion of the casing, respectively. The upper shell and lower shell are bonded to the casing to form one confined space together with the casing.

A discharge pipe 116 is provided at an upper portion of the upper shell 112. The discharge pipe 116 corresponds to a path through which compressed refrigerant is discharged to the outside, and an oil separator (not shown) for separating oil mixed with the discharged refrigerant may be connected to the discharge pipe 116. Furthermore, a suction pipe 118 is provided at a lateral surface of the casing 110. As a path through which refrigerant to be compressed flows, the suction pipe 118 is located at a boundary surface between the casing 110 and the upper shell 112 in FIG. 1, but the location may be set at discretion. Moreover, the lower shell 114 may also function as an oil chamber for storing oil supplied to operate the compressor in an efficient manner.

A motor 120 as a driving unit is provided at a substantially central portion of the inner portion of the casing 110. The motor 120 may include a stator 122 fixed to an inner surface of the casing 110 and a rotor 124 located at an inner portion of the stator 122 to be rotated by an interaction with the stator 122. A rotation shaft 126 is combined with the center of the rotor 124 and rotated together with the rotor 124.

An oil passage 126*a* is formed at an central portion of the rotation shaft 126 to be extended along a length direction of the rotation shaft 126, and an oil pump 126*b* for supplying oil stored in the lower shell 114 to the upper portion thereof is provided at a lower end portion of the rotation shaft 126. The oil pump 126*b* may have a shape in which a spiral groove is formed or a separate impeller is provided at an inner portion of the oil passage, and a separate capacity type pump may be provided therein.

Figure 3:
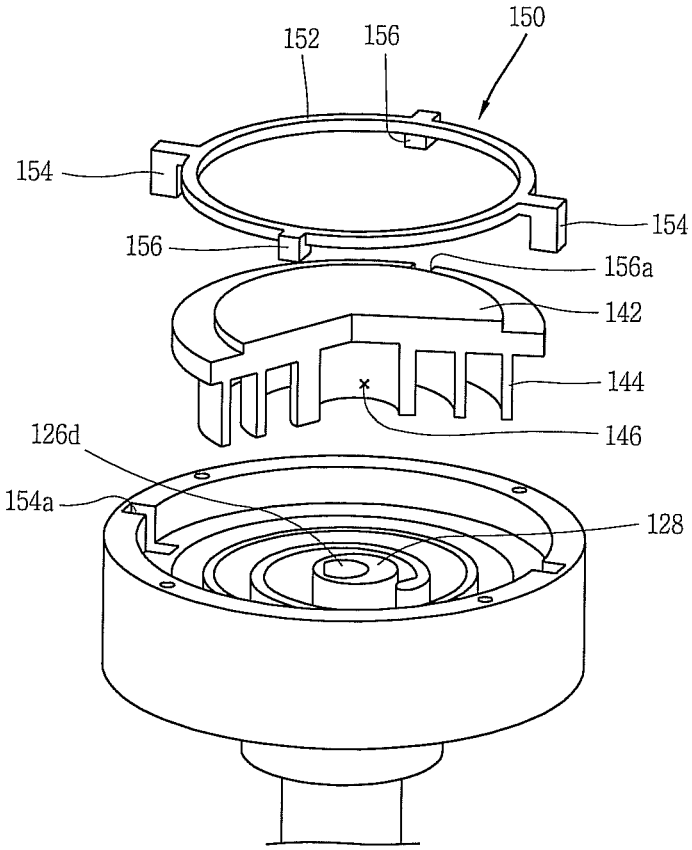
FIG. 3 is an exploded perspective view illustrating a compression unit illustrated in FIG. 2.

An enlarged diameter portion 126*c* inserted into an inner portion of the boss portion formed on the fixed scroll which will be described later is formed at an upper end portion of the rotation shaft 126. The enlarged diameter portion is formed to have a diameter larger than the other portion thereof, and a pin portion 126*d* forming an eccentric portion together with the eccentric bearing 128 which will be described later is formed at an end portion of the enlarged diameter portion. The eccentric bearing 128 for forming an eccentric portion together with the pin portion 126*d* is inserted into the pin portion 126*d*, and referring to FIG. 3, the eccentric bearing 128 is eccentrically inserted with respect to the pin portion 126*d*, and a combining portion for both is asymmetrically formed in a substantially "D" shape based on the center of the pin portion such that the eccentric bearing 128 is not rotated with respect to the pin portion 126*d*.

A fixed scroll 130 is mounted on a boundary portion between the casing 110 and upper shell 112. The fixed scroll 130 is pushed and fixed between the casing 110 and the upper shell 112 in a shrink fit manner or combined together with the casing 110 and upper shell 112 by welding.

A boss portion 132 into which the foregoing rotation shaft 126 is inserted is formed at a bottom surface of the fixed scroll 130. A penetration hole through which the pin portion 126*d* of the rotation shaft 126 passes is formed at an upper side surface (based on FIG. 1) of the boss portion 132 and thus the pin portion 126*d* is protruded in the upward direction of the end plate portion 134 of the fixed scroll 130 therethrough.

A fixed wrap 136 engaged with the orbiting wrap which will be described later to form a compression chamber is formed at an upper portion surface of the end plate portion 134, and a space portion for accommodating the orbiting scroll 140 which will be described later is formed, and a lateral wall portion 138 adjoining an inner circumferential surface of the casing 110 is formed at an outer circumferential portion of the end plate portion 134. A orbiting scroll support portion 138*a* on which an outer circumferential portion of the orbiting scroll 140 is placed is formed at an inner side of the upper end portion of the lateral wall portion 138, and the height of the orbiting scroll support portion 138*a* is formed to have the same height as the fixed wrap 136 or to have a height slightly less than that of the fixed wrap, and thus an end portion of the orbiting wrap can be brought into contact with a surface of the end plate portion of the fixed scroll.

The orbiting scroll 140 is provided at an upper portion of the fixed scroll 130. The orbiting scroll 140 is formed with a substantially orbiting shaped end plate portion 142 and a orbiting wrap 144 engaged with the fixed wrap 136. A substantially orbiting shaped rotation shaft combining portion 146 rotatably inserted and fixed to the eccentric bearing 128 is formed at a central portion of the end plate portion 142. An outer circumferential portion of the rotation shaft combining portion 146 is connected to the orbiting wrap to perform the role of forming a compression chamber together with the fixed wrap during the compression process. It will be described later.

On the other hand, the eccentric bearing 128 is inserted into the rotation shaft combining portion 146 and thus an end portion of the rotation shaft 126 is inserted through the end plate portion of the fixed scroll, and the orbiting wrap, fixed wrap and eccentric bearing 128 are provided to be overlapped with one another in the radial direction of the compressor. During compression, a repulsive force of refrigerant is applied to the fixed wrap and orbiting wrap, and a compression force is applied between the rotation shaft support portion and eccentric bearing as a reaction force thereto. As described above, when part of the shaft is overlapped with the wrap in a radial direction through the end plate portion, the repulsive force and compression force of refrigerant are applied to the same surface based on the end plate, and thus they are cancelled out by each other. Due to this, it may be possible to prevent the inclination of the orbiting scroll by the operation of the compression force and repulsive force.

Furthermore, though not shown in the drawing, a discharge hole is formed on the end plate portion 142 and thus compressed refrigerant may be discharged to an inner portion of the casing. The location of the discharge hole may be set at discretion by taking a required discharge pressure or the like into consideration.

Furthermore, an oldham ring 150 for preventing the rotation of the orbiting scroll is provided at an upper side of the orbiting scroll 140. The oldham ring 150 may include a substantially orbiting shaped ring portion 152 inserted into a rear surface of the orbiting scroll 140 and a pair of first key 154 and second key 156 which are protruded on a lateral surface of the ring portion 152. The first key 154 is protruded farther than the thickness of an outer circumferential side of the end plate portion 142 of the orbiting scroll 140, and inserted into an inner portion of the first key groove 154*a* formed over an upper end of the lateral wall portion 138 of the fixed scroll 130 and the orbiting scroll support portion 138*a*. Moreover, the second keys 156 are combined with the second key grooves 156*a*, respectively, formed at an outer circumferential portion of the end plate portion 142 of the orbiting scroll 140 in the state of being inserted therein.

Here, the first key groove 154*a* is formed to have a vertical portion extended in the upward direction and a horizontal portion extended in the left/right direction, and a lower side end portion of the first key 154 always maintains a state of being inserted in the horizontal portion of the first key groove 154*a*, but an outer side end portion of the first key 154 in the radial direction is formed to be released from the vertical portion of the first key groove 154*a* during the orbiting movement of the orbiting scroll. In other words, a coupling between the first key groove 154*a* and the fixed scroll is made in the vertical direction, thereby reducing the diameter of the fixed scroll.

Specifically, a clearance as much as corresponding to a orbiting radius should be secured between an end plate of the orbiting scroll and an inner wall of the fixed scroll. If a key of the oldham ring is combined with the fixed scroll in the radial direction, then the length of a key groove formed on the fixed scroll should be at least greater than the orbiting radius to prevent the oldham ring from being released from the key groove during the orbiting process, and it may be a cause of increasing the size of the fixed scroll.

On the contrary, as in the above embodiment, if the key groove is extended to a lower space between the end plate and the orbiting wrap in the orbiting scroll, it may be possible to secure a sufficient length of the key groove and reducing the size of the fixed scroll.

Moreover, in the above embodiment, all keys are formed at a lateral surface of the ring portion, and thus the height of the compression unit in the axial direction can be reduced compared to a case that keys are formed, respectively, in both lateral surfaces thereof.

On the other hand, a lower frame 160 for rotatably supporting a lower side of the rotation shaft 126 is provided at a lower portion of the casing 110, and the orbiting scroll and an upper frame 170 for supporting the oldham ring 150 are provided, respectively, at an upper portion of the orbiting scroll. A hole communicated with a discharge hole of the orbiting scroll 140 to discharge compressed refrigerant to the side of the upper shell is formed at the center of the upper frame 170.

Figure 4:
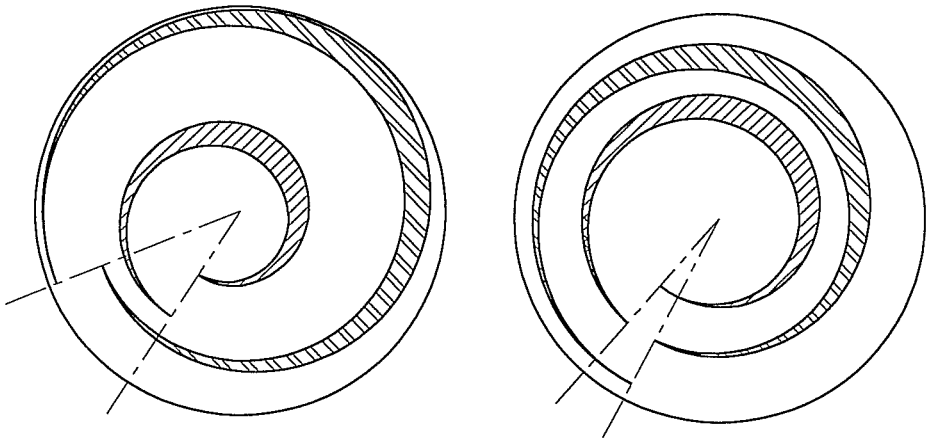
FIG. 4 is a plan view illustrating a first and a second compression chamber immediately subsequent to inhalation and immediately prior to discharge in a scroll compressor having a orbiting wrap and a fixed wrap with an involute shape.

FIG. 4 is a plan view illustrating a compression chamber immediately subsequent to inhalation and a compression chamber immediately prior to discharge in a scroll compressor having a orbiting wrap and a fixed wrap formed with an involute curve, and having a configuration that part of the shaft penetrates the end plate. FIG. 4A is a view illustrating a change of the first compression chamber formed between an inner lateral surface of the fixed wrap and an outer lateral surface of the orbiting wrap, and FIG. 4B is a view illustrating a change of the second compression chamber formed between an inner lateral surface of the orbiting wrap and an outer lateral surface of the fixed wrap.

In the scroll compressor, the compression chamber is created between two contact points generated when the fixed wrap and orbiting wrap are brought into contact with each other, and in case of the fixed wrap and orbiting wrap with an involute curve, two contact points defining one compression chamber as illustrated in FIG. 4 are located on a straight line. In other words, the compression chamber is disposed over 360° with respect to the center of the rotation shaft.

Considering a volume change of the first compression chamber in FIG. 4A, the volume of the compression chamber immediately subsequent to inhalation located at the outside is gradually reduced while moving to the central portion thereof by a orbiting movement of the orbiting scroll, and thus has a minimum value when reaching an outer circumferential portion of the rotation shaft combining portion located at the center of the orbiting scroll. In case of the fixed wrap and orbiting wrap with an involute curve, the volume reduction rate is linearly reduced as increasing the rotation angle of the rotation shaft, and thus the compression chamber should be moved closely to the center if possible, to obtain a high compression ratio, but in case where the rotation shaft exists at the center as described above, it can be moved only to an outer circumferential portion of the rotation shaft. Due to this, the compression ratio is reduced, and the compression ratio is about 2.13 in FIG. 4A.

Figure 5:
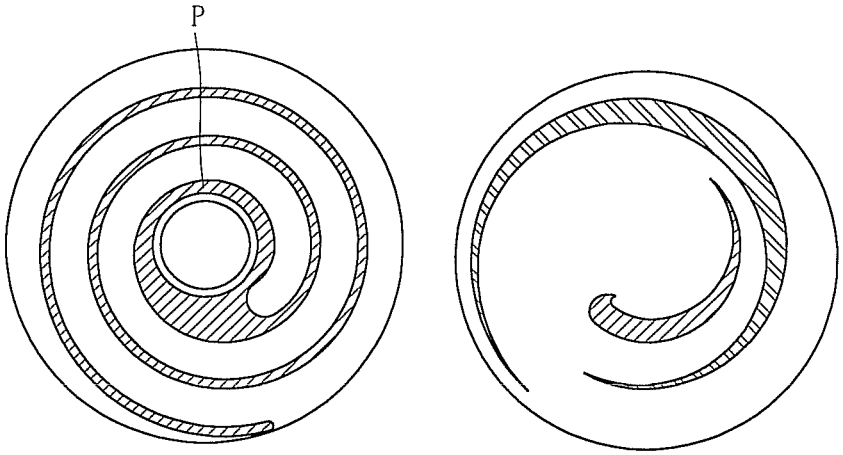
FIG. 5 is a plan view illustrating a type of orbiting wrap in a scroll compressor having a orbiting wrap and a fixed wrap with another involute shape.

On the other hand, the second compression chamber illustrated in FIG. 4B has a lower compression ratio compared to the first compression chamber, and thus has a value of about 1.46. However, in case of the second compression chamber, when a connecting portion between the rotation shaft combining portion (P) and the orbiting wrap is formed with a orbiting arc shape as illustrated in FIG. 5A, a compression path of the second compression chamber is lengthened, thereby increasing the compression ratio up to a level of 3.0. In this case, the second compression chamber has a range of less than 360 degrees immediately prior to discharge. However, such a method cannot be applicable to the first compression chamber.

Accordingly, in case of the fixed wrap and orbiting wrap with an involute shape, an intentional level of compression ratio can be obtained in case of the second compression chamber, but it is impossible in case of the first compression chamber, and as a result, in case that there is a remarkable difference of compression ratio between the two compression chambers, it will affect a bad effect on the operation of the compressor.

Figure 6:
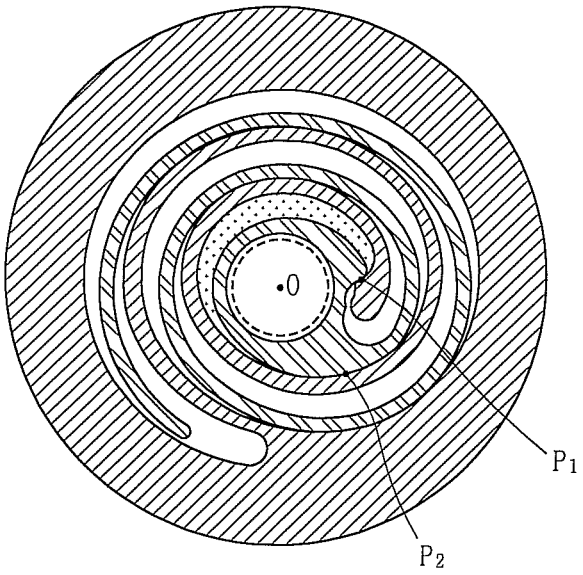
FIG. 6 is a plan view illustrating a orbiting wrap and a fixed wrap obtained by another envelope line.
Figure 7:
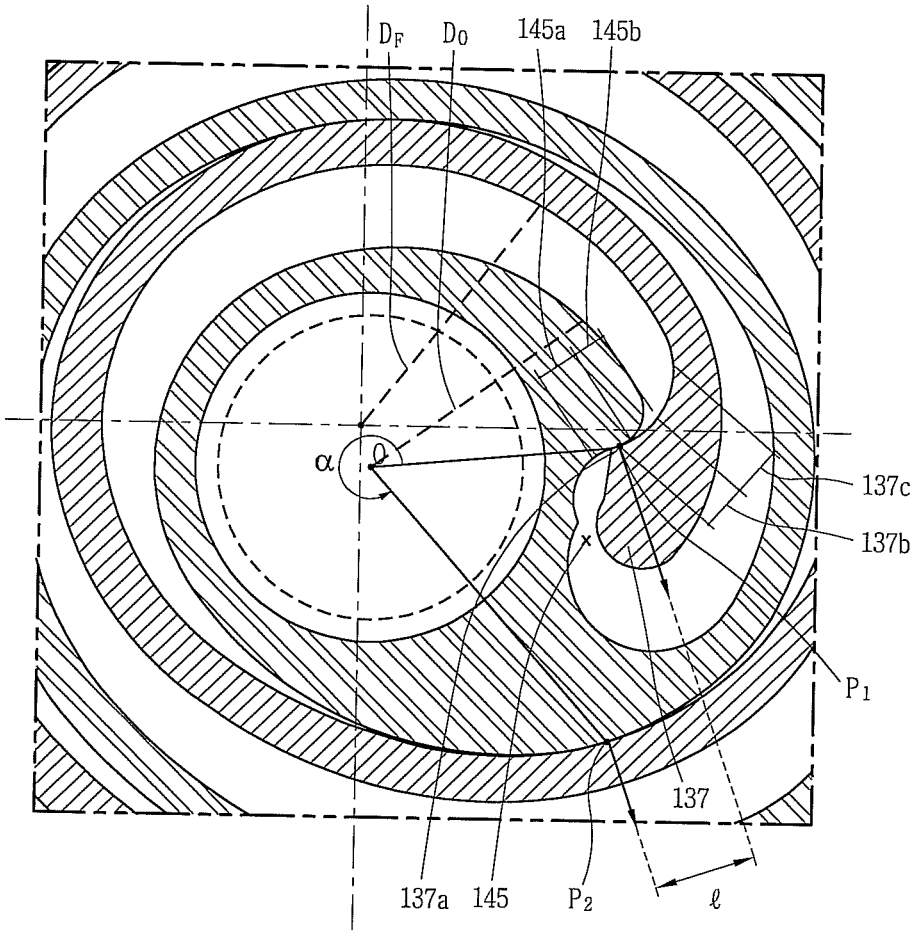
FIG. 7 is an enlarged plan view illustrating a central portion thereof in FIG. 6.

In order to solve the foregoing problem, the fixed wrap and orbiting wrap may be formed to have another curve other than the involute curve. Referring to FIGS. 6 and 7, when the center of the rotation shaft combining portion 146 is "O", and two contact points are "P1, P2", respectively, it is seen that an angle $\alpha$ defined by two straight lines connecting the two contact points (P1, P2) to the center (O) of the rotation shaft combining portion is less than 360°, and also a distance "I" between perpendicular vectors at each contact point has a value greater than "0". Due to this, the first compression chamber immediately prior to discharge has a volume less than a case of the fixed wrap and orbiting wrap formed with an involute curve, thereby increasing the compression ratio. Furthermore, the orbiting wrap and fixed wrap illustrated in FIG. 6 have a configuration in which the diameter and starting point thereof are connected to a plurality of different orbiting arcs, and the outermost curve has a substantially oval shape having the major and minor axes.

Furthermore, a protrusion portion 137 protruded to the side of the rotation shaft combining portion 146 is formed adjacent to an inner side end portion of the fixed wrap, and a contact portion 137*a* formed to be protruded from the protrusion portion is additionally formed on the protrusion portion 137. In other words, the inner side end portion of the fixed wrap is formed to have a thickness greater than the other portion thereof. Due to this, a strength of the inner side end portion of the wrap receiving the highest compression force on the fixed wrap can be enhanced, thereby enhancing the durability.

On the other hand, the thickness of the fixed wrap is gradually decreased from the contact point (P1) located at an inner side between the two contact points forming the first compression chamber at a discharge start time point as illustrated in FIG. 7. Specifically, a first decreasing portion 137*b* adjacent to the contact point (P1) and a second decreasing portion 137*c* adjacent to the first decreasing portion are formed, and a thickness reduction rate at the first decreasing portion is greater than that at the second decreasing portion. Furthermore, the thickness of the fixed wrap is increased for a predetermined section subsequent to the second decreasing portion.

Figure 8:
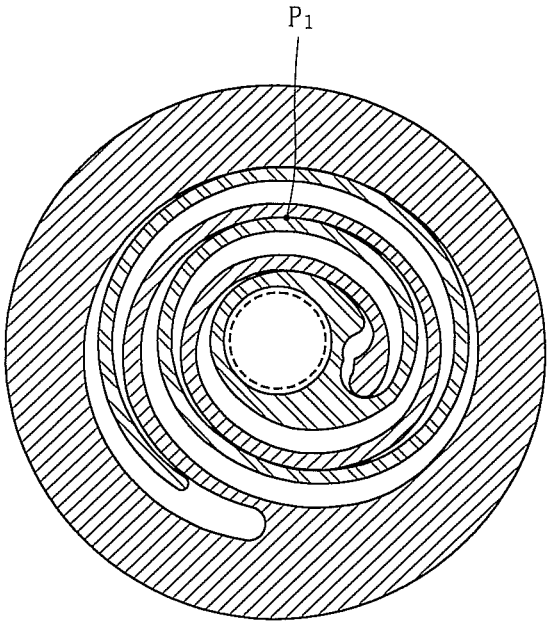
FIG. 8 is a plan view illustrating a configuration in which the orbiting wrap is located prior to 150° starting discharge in the embodiment illustrated in FIG. 6.

Furthermore, when a distance between an inner surface of the fixed wrap and the axial center (O') of the rotation shaft is DF, the DF is decreased after being increased as moving in a counter clockwise direction (based on FIG. 7) from the P1, and the section thereof is shown in FIG. 8. FIG. 8 is a plan view illustrating the location of the orbiting wrap prior to 150° starting discharge, and the orbiting wrap reaches a configuration illustrated in FIG. 6 when the rotation shaft is further rotated by 150° from the configuration of FIG. 8. Referring to FIG. 8, the contact point is located at an upper side of the rotation shaft combining portion 146, and the DF is increased and then decreased during the section between P1 of FIG. 6 and P1 of FIG. 8.

A concave portion 145 engaged with the protrusion portion is formed at the rotation shaft combining portion 146. A lateral surface of the concave portion 145 is brought into contact with the contact portion 137*a* of the protrusion portion 137 to form a side contact point of the first compression chamber. When a distance between the center of the rotation shaft combining portion 146 and an outer circumferential portion of the rotation shaft combining portion 146 is "Do", the "Do" is increased and then decreased during the section between P1 of FIG. 6 and P1 of FIG. 8. Similarly, the thickness of the rotation shaft combining portion 146 is also increased and then decreased during the section between P1 of FIG. 6 and P1 of FIG. 8.

Furthermore, a side wall of the concave portion 145 may include a first increasing portion 145*a* in which the thickness thereof is drastically increased in a relatively high rate and a second increasing portion 145*b* connected to the first increasing portion in which the thickness is increased in a relatively low rate. They correspond to the first decreasing portion and the second decreasing portion, respectively. The first increasing portion, first decreasing portion, second increasing portion, and second decreasing portion are obtained as a result of bending the envelope line toward the rotation shaft combining portion. Due to them, an inner side contact point (P1) forming the first compression chamber is located at the first increasing portion and second increasing portion, and as a result, the compression ratio can be increased by decreasing the length of the first compression chamber immediately prior to discharge.

The other side wall of the concave portion 145 is formed to have a orbiting arc shape. The diameter of the orbiting arc is determined by a wrap thickness of the end portion of the fixed wrap and a orbiting radius of the orbiting wrap, and the diameter of the orbiting arc is increased as increasing the thickness of the end portion of the fixed wrap. Due to this, the thickness of the orbiting wrap around the orbiting arc is also increased to secure the durability, and the compression path is lengthened and thus has an advantage of increasing the compression ratio of the second compression chamber as much as the lengthened path.

Figure 9:
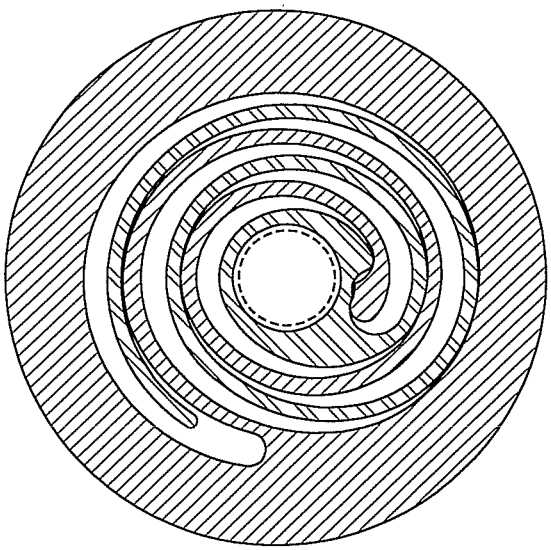
FIG. 9 is a plan view illustrating a time point at which discharge is started from the second compression chamber in the embodiment illustrated in FIG. 6.

Here, a central portion of the concave portion 145 forms part of the second compression chamber. FIG. 9 is a plan view illustrating the location of the orbiting wrap when discharge is started from the second compression chamber, and the second compression chamber is located adjacent to a orbiting shaped side wall of the concave portion in FIG. 9, and when the rotation shaft is further rotated, an end portion of the second compression chamber passes through a central portion of the concave portion.

On the other hand, in case of a shaft penetration scroll compressor as described above, a gas force is eccentrically exerted because the discharge port is eccentrically formed with respect to the center of the rotation shaft, thereby causing tilting of the orbiting scroll due to the eccentricity of a gas force.

Taking this into account, according to the present embodiment, an oil hole is formed at the fixed scroll 130 to support the orbiting scroll 140 with high-pressure oil, thereby preventing tilting of the orbiting scroll 140 in advance.

Figure 10:
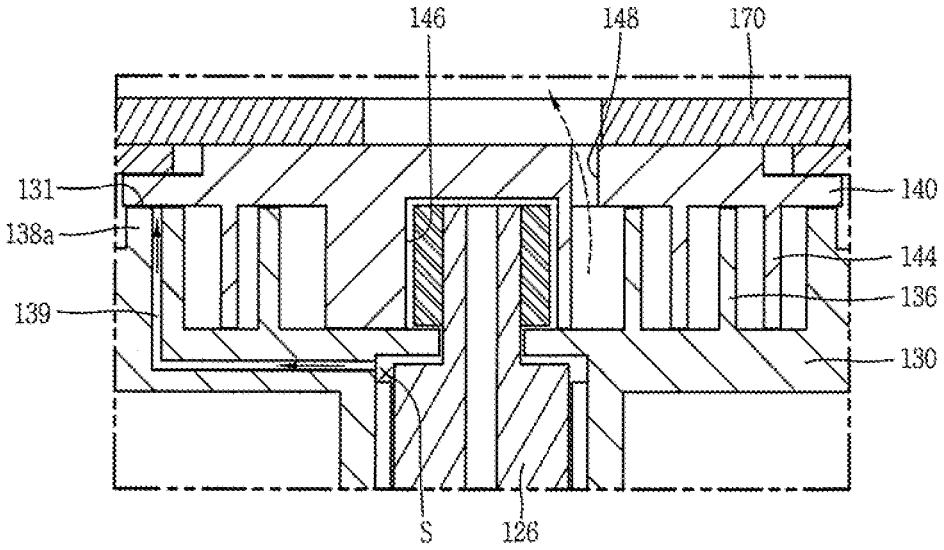
FIG. 10 is a cross-sectional view illustrating an oil hole according to the embodiment illustrated in FIG. 1.
Figure 11:
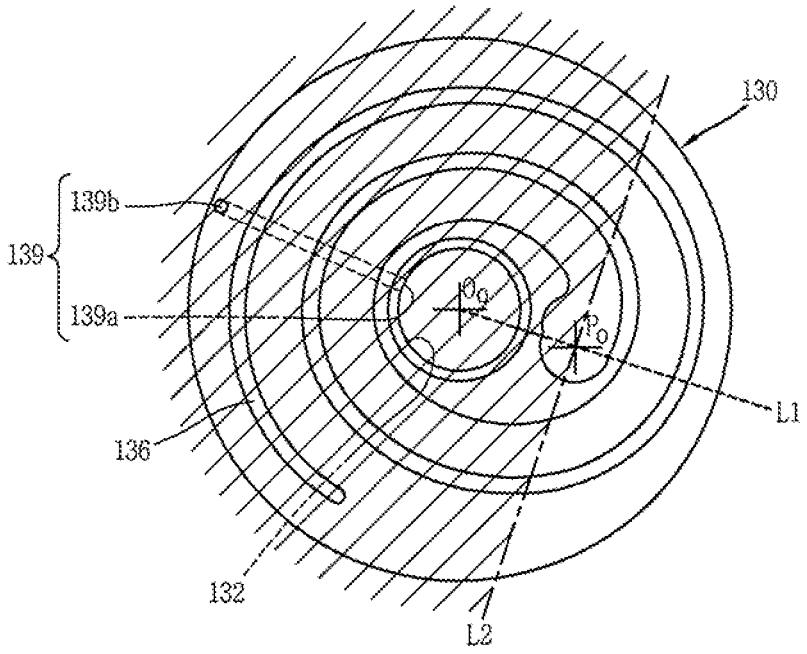
FIG. 11 is a plan view illustrating a fixed scroll having an oil hole illustrated in FIG. 10.

For example, as illustrated in FIGS. 10 and 11, an inlet end 139*a* of the oil hole 139 passes through an inner circumferential surface of the boss portion 132 of the fixed scroll 130 in a radial direction whereas an outlet end 139*b* of the oil hole 139 is formed to pass through the thrust bearing surface 131.

The outlet end 139*b* of the oil hole 139 is preferably formed to exert a support force in an opposite direction to an axially directional gas force in which a gas force is exerted in an axial direction. In other words, when a line connecting the center (Po) of the compression chamber immediately prior to discharge to the geometric center (Oo) of the orbiting scroll is referred to as a first reference line (L1) and a line perpendicular to the first reference line (L1) at the center (Po) of the compression chamber is referred to as a second reference line (L2), the outlet end 139*b* of the oil hole 139 may be preferably formed at the side at which a geometric center of the orbiting scroll is located.

Here, an upper end of the shaft portion of the rotation shaft 126 and an upper side surface of the boss portion 132 are separated from each other by a predetermined distance to form an oil supply space (S) so that the inlet end 139*a* of the oil hole 139 can be always open with respect to the rotation shaft 126, and the inlet end 139*a* of the oil hole 139 is preferably formed to be communicated with the oil supply space (S).

In a scroll compressor according to the present embodiment as described above, part of oil inhaled through the rotation shaft 126 is supplied to the oil supply space (S) and lubricated between the rotation shaft 126 and boss portion 132.

Furthermore, part of oil inhaled through the rotation shaft 126 that has been supplied to the oil supply space (S) and lubricated between the rotation shaft 126 and boss portion 132 is supplied to the thrust bearing surface 131 to support a bottom surface at the axial center side of the orbiting scroll 140, thereby preventing the axial center side from being tilted by a high gas force due to the gas force eccentricity of the orbiting scroll 140.

Through this, in a shaft penetration scroll compressor in which the rotation shaft 126 is overlapped and combined with the orbiting wrap 144 of the orbiting scroll 140 in a radial direction, a tilting phenomenon of the orbiting scroll 140 due to the eccentricity of a gas force generated when the discharge port 148 is eccentrically formed with respect to the center of the rotation shaft 126 can be prevented, thereby enhancing the compressor performance.

What is claimed is:

1. A scroll compressor, comprising:

a fixed scroll having a fixed wrap;

an orbiting scroll having an orbiting wrap engaged with the fixed wrap to form first and second compression chambers at an outer surface and an inner surface of the orbiting wrap, respectively, that performs an orbiting movement with respect to the fixed scroll;

a rotational shaft having an eccentric portion, and an oil passage that extends in an axial direction, and combined with the orbiting scroll such that the eccentric portion overlaps the orbiting wrap in a radial direction; and a drive configured to drive the rotational shaft, wherein an oil hole is formed at the fixed scroll to supply oil inhaled through the oil passage of the rotational shaft to a thrust bearing surface of the orbiting scroll, wherein an outlet end of the oil hole is formed at the thrust bearing surface of the orbiting scroll, wherein when a line that connects a center of a compression chamber immediately prior to discharge to a geometric center of the orbiting scroll is referred to as a first reference line and a line that extends perpendicular to the first reference line at the center of the compression chamber is referred to as a second reference line, the outlet end of the oil hole is formed at a side of the second reference line at which the geometric center of the orbiting scroll is located.

2. The scroll compressor of claim 1, wherein a boss portion is formed at the fixed scroll into which the rotational shaft is inserted and rotatably supported, and wherein an inlet end of the oil hole is formed to pass through an inner portion of the boss portion.

3. The scroll compressor of claim 1, wherein the first compression chamber is formed between two contact points generated when an inner surface of the fixed wrap and the outer surface of the orbiting wrap are brought into contact with each other, and wherein when an angle having a greater value between angles made by two lines that connect a center of the eccentric portion to the two contact points, respectively, is $\alpha,\alpha<360°$ at least prior to starting the discharge.

4. The scroll compressor of claim 3, wherein when a distance between perpendiculars at the two contact points is 1, 1>0.

5. The scroll compressor of claim 1, wherein a rotational shaft combining portion combined with the eccentric portion is formed at a central portion of the orbiting scroll, wherein a protrusion portion is formed at an inner circumferential surface of an inner end portion of the fixed wrap, and wherein a concave portion which is brought into contact with the protrusion portion to form a compression chamber is formed at an outer circumferential surface of the rotational shaft combining portion.

6. A scroll compressor, comprising:

a fixed scroll having a fixed wrap;

an orbiting scroll having an orbiting wrap engaged with the fixed wrap to form a plurality of compression chambers at an inner surface and an outer surface of the orbiting wrap, respectively, that performs an orbiting movement with respect to the fixed scroll;

a rotational shaft having an eccentric portion, and combined with the orbiting scroll such that the eccentric portion overlaps the orbiting wrap in a radial direction; and a drive configured to drive the rotational shaft, wherein a boss portion is formed at the fixed scroll into which the rotational shaft is inserted and rotatably supported, wherein an inlet end of an oil hole is formed to pass through an inner circumferential surface of the boss portion, wherein an outlet end of the oil hole is formed at a thrust bearing surface of the orbiting scroll, wherein when a line that connects a center of a compression chamber of the plurality of compression chambers immediately prior to discharge to a geometric center of the orbiting scroll is referred to as a first reference line and a line perpendicular to the first reference line at the center of the compression chamber is referred to as a second reference line, the outlet end of the oil hole is formed at a side of the second reference line at which the geometric center of the orbiting scroll is located.

7. The scroll compressor of claim 6, wherein a first compression chamber of the plurality of compression chambers is formed between two contact points generated when an inner surface of the fixed wrap and the outer surface of the orbiting wrap are brought into contact with each other, and wherein when an angle having a greater value between angles made by two lines that connect a center of the eccentric portion to the two contact points, respectively, is $\alpha,\alpha<360°$ at least prior to starting the discharge.

8. The scroll compressor of claim 7, wherein when a distance between perpendiculars at the two contact points is 1,1>0.

9. The scroll compressor of claim 6, wherein a rotational shaft combining portion combined with the eccentric portion is formed at a central portion of the orbiting scroll, wherein a protrusion portion is formed at an inner circumferential surface of an inner end portion of the fixed wrap, and wherein a concave portion which is brought into contact with the protrusion portion to form a compression chamber is formed at an outer circumferential surface of the rotational shaft combining portion.

10. A scroll compressor, comprising:

a fixed scroll having a fixed wrap;

an orbiting scroll having an orbiting wrap engaged with the fixed wrap to form first and second compression chambers at an outer surface and an inner surface of the orbiting wrap, respectively, that performs an orbiting movement with respect to the fixed scroll;

a rotational shaft having an eccentric portion and an oil passage that extends in an axial direction, and combined with the orbiting scroll such that the eccentric portion overlaps the orbiting wrap in a radial direction;

a drive configured to drive the rotational shaft; and an oil hole formed at the fixed scroll to supply oil inhaled through the oil passage of the rotational shaft to the orbiting scroll, wherein an outlet end of the oil hole is formed at a orbiting scroll support portion of the fixed scroll, wherein the orbiting scroll support portion includes a thrust bearing surface and surrounds the fixed wrap and the orbiting wrap, and wherein the outlet end of the oil hole faces a thrust bearing surface of the orbiting scroll such that a portion of oil supplied through the outlet end of the oil hole is fed to the thrust bearing surface of one side of the orbiting scroll.

11. The scroll compressor of claim 10, wherein when a line that connects a center of a compression chamber immediately prior to discharge to a geometric center of the orbiting scroll is referred to as a first reference line and a line perpendicular to the first reference line at the center of the compression chamber is referred to as a second reference line, the outlet end of the oil hole is formed at a side of the second reference line at which the geometric center of the orbiting scroll is located.

12. The scroll compressor of claim 10, wherein a boss portion is formed at the fixed scroll into which the rotational shaft is inserted and rotatably supported, and wherein an inlet end of the oil hole is formed to pass through an inner portion of the boss portion.

13. The scroll compressor of claim 10, wherein the first compression chamber is formed between two contact points generated when an inner surface of the fixed wrap and the outer surface of the orbiting wrap are brought into contact with each other, and wherein when an angle having a greater value between angles made by two lines that connect a center of the eccentric portion to the two contact points, respectively, is $\alpha,\alpha<360°$ at least to starting the discharge.

14. The scroll compressor of claim 13, wherein when a distance between perpendiculars at the two contact points is 1, 1>0.

15. The scroll compressor of claim 10, wherein a rotational shaft combining portion combined with the eccentric portion is formed at a central portion of the orbiting scroll, wherein a protrusion portion is formed at an inner circumferential surface of an inner end portion of the fixed wrap, and wherein a concave portion which is brought into contact with the protrusion portion to form a compression chamber is formed at an outer circumferential surface of the rotational shaft combining portion.

* * * * *